United States Patent [19]

Campbell

[11] Patent Number: 4,830,573

[45] Date of Patent: May 16, 1989

[54] HIGH PRESSURE PUMP WITH PLASTIC PUMP HOUSING AND HEAT SINK

[75] Inventor: Jack F. Campbell, Guelph, Canada

[73] Assignee: GSW Inc., Fergus, Canada

[21] Appl. No.: 141,156

[22] Filed: Jan. 6, 1988

[51] Int. Cl.[4] ..... F04D 29/58

[52] U.S. Cl. ..... 415/177; 417/372; 415/200

[58] Field of Search ..... 415/170 A, 177, 178, 415/200, 201, 219 C, 214; 417/372, 373

[56] References Cited

U.S. PATENT DOCUMENTS

| | | | |
|---|---|---|---|
| 3,115,844 | 12/1963 | Maitlen | 415/200 |
| 3,329,171 | 7/1967 | Sibbald | 415/200 X |
| 3,822,967 | 7/1974 | Cade et al. | 417/372 X |
| 3,826,589 | 7/1974 | Frank et al. | 415/201 X |
| 3,829,238 | 8/1974 | Speck | 415/200 X |
| 3,947,154 | 3/1976 | Klepp et al. | 417/372 X |
| 4,052,133 | 10/1977 | Yeater | 415/200 |
| 4,239,462 | 12/1980 | Dach et al. | 417/353 |

FOREIGN PATENT DOCUMENTS

| | | | |
|---|---|---|---|
| 2402785 | 5/1979 | France | 415/200 |

*Primary Examiner*—Robert E. Garrett
*Assistant Examiner*—Joseph M. Pitko

[57] ABSTRACT

The present invention provides a pump arrangement formed with a plastic pump housing and a motor housing secured to one another. A heat transfer member extends between the housings for picking up heat generated in the pump chamber of the plastic pump housing and transferring the heat for dissipation internally of the motor housing.

2 Claims, 3 Drawing Sheets

HIGH PRESSURE PUMP WITH PLASTIC PUMP HOUSING AND HEAT SINK

FIELD OF THE INVENTION

The present invention relates to a pump and in particular a pump formed with a plastic pump housing.

BACKGROUND OF THE INVENTION

In accordance with standard practice, high pressure pumps such as jet pumps and the like are made with a full metal construction in order to sustain the pressures experienced by the pump. However, a totally metal pump construction does present drawbacks particularly wih respect to corrosion and also with respect to packaging and shipping due to the weight of the metal.

Advances have been made in the construction of pumps through the use of plastic materials alleviating the problems mentioned above. However, the introduction of plastic has brought on a whole new set of problems including heat breakdown which does not occur in a metallic construction.

One example of a plastic pump construction is found in U.S. Pat. No. 3,826,589 issued July 30, 1974 to Starite Industries Inc. According to this patent, a jet pump is formed by a pair of plastic housing sections.

In order to reduce the likelihood of heat related damage to the Starite pump, it includes a metallic shield in the area around the seals at the motor shaft of the pump. This heat shield is designed to keep the heat buildup away from the seals by conducting the heat into the water within the pump chamber of the plastic pump. The heat shield is not designed to carry the heat out of the plastic housing leaving it subject to heat related damage. Furthermore, if the pump looses its prime and the pump chamber is not filled with cooling circulating water, then the pump chamber itself is subject to overheating.

SUMMARY OF THE PRESENT INVENTION

The present invention provides a pump arrangement which mitigates the problems associated with a full metal construction and which is designed to overcome the problems discussed immediately above with respect to overheating of a plastic pump construction. More particularly, the pump arrangement of the present invention comprises a plastic pump housing and a motor housing secured to one another. The pump arrangement includes heat transfer means extending between the housings such that the heat transfer means picks up heat generated in the plastic pump housing and transfers it to for dissipation within the motor housing.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
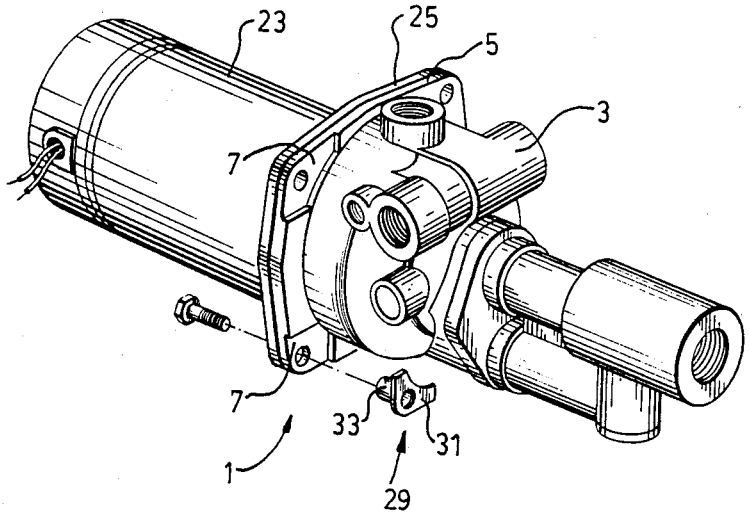
FIG. 1 is a perspective view of a jet pump formed with a plastic pump housing and a motor housing according to a preferred embodiment of the present invention.

FIG. 1 shows a pump and in particular a jet pump, generally indicated at 1. This pump includes a pump end or housing 3 and a motor end or housing 23. The pump housing includes a flange 5 secured to flange 25 of the motor housing.

Figure 2:
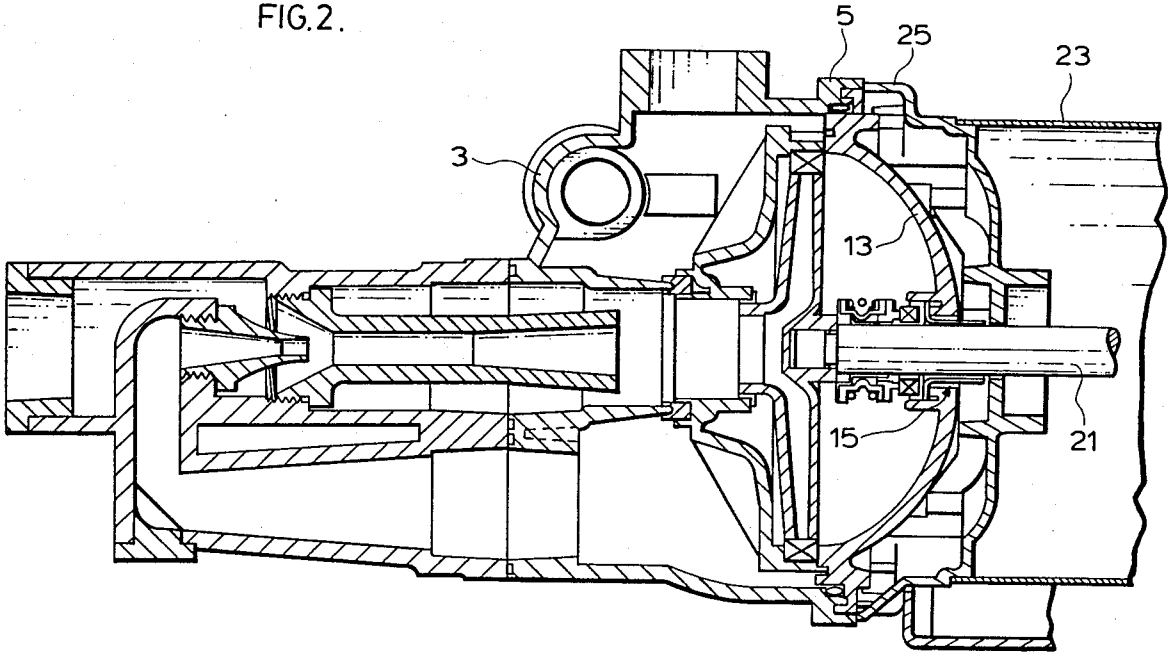
FIG. 2 is a sectional view showing the pump housing and its connection with the motor housing from the pump of FIG. 1.

Unlike conventional practice, the pump housing 3 is formed from a plastic material such a nylon or the like. The motor housing is constructed from a metallic material such as cast-iron. Alternatively, the motor housing could also have a plastic construction with a reinforced end flange, e.g. a fibreglass-reinforced end flange. The use of plastic material in the pump housing as well as its interior components as seen in FIG. 2 of the drawings, eliminates corrosion problems in the pump side and substantially reduces the overall weight and shipping requirements for the pump in comparison to a conventional fully iron pump.

The pump of the present invention is provided with a specific securing arrangement to prevent deflection of the plastic pump housing flange away from the stronger flange of the motor housing. Moreover, this is done without making the pump housing flange unduly bulky, which, is no thicker than the motor housing flange as seen in FIG. 1 of the drawings. Also, shown in FIG. 1 is the securing arrangement in the form of a bolt 27 fitted through aligned openings in the flanges to a nut 29 which reinforces the plastic pump housing flange. This nut consists of a metallic plate 31 and a threaded stem 33 extending at right angles to the plate for receiving bolt 27. The plastic pump housing flange has a recess 7 corresponding to the shape of the plate portion of the nut so that its outer surface fits flushly with the outer surface of the pump housing flange. In addition, this recessing in the flange provides a locking feature so that the nut will not turn during the tightening of the bolt.

Note that plate portion 31 of nut 29 has a rounded triangular configuration for fitting of four nuts at the corners of the flange to flange connection. The plate portion of the nut then extends partially around each of those corners so that there is only a limited unsupported region between each of the corner nuts along the plastic flange. Therefore, the support or reinforcement provided by the nut and bolt combination is more than sufficient to prevent any significant causing deflection of the plastic pump housing flange.

Figure 4:
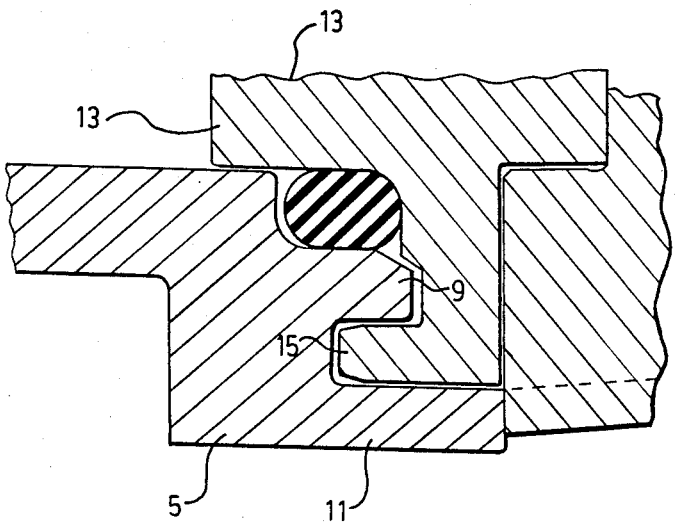
FIG. 4 is an enlarged sectional view of the fitting of the seal plate with the plastic pump housing of FIG. 2.

In addition to the housing, the internal components of the pump side have a plastic construction. One of these components is seal plate 13 which is designed with a specific interlock with the pump housing. This interlock which is shown in FIG. 4 of the drawings, is in the form of a tongue and groove fit where the seal plate is provided with tongue 15 fitted into a groove in the pump housing bordered to either side by pump housing sections 9 and 11. This tongue and groove interlock, running completely around the seal plate, ensures that the tongue 11 formed in the molding of the seal plate and if not perfectly round will still be forced from both the inside and the outside to sit in the groove provided in the pump housing.

The pump is designed for transferring heat from the pump to the motor side and specifically away from the pump chamber where there can be a substantial heat buildup when there is a loss of prime in the pump and little if any water in the pump chamber.

Figure 3:
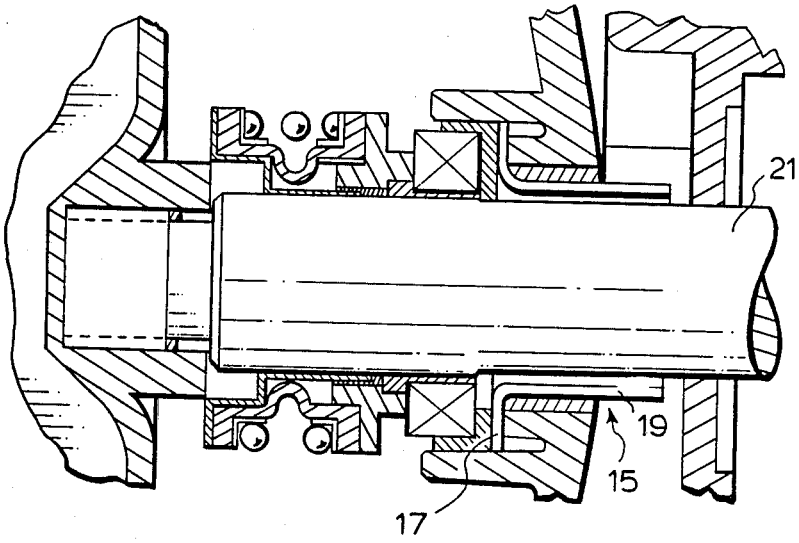
FIG. 3 is an enlarged sectional view showing the heat transfer means from the pump to the motor housing of the pump of FIGS. 1 and 2.

The heat transfer means is provided in the form of a heat transfer member or heat sink 15 as shown in FIGS. 2 and 3 of the drawings. This heat transfer member which is made of a heat conductive material such as copper or the like has a top hat-like configuration. This configuration includes a radial flange heat pick up end 17 located in the pumping chamber immediately behind seal plate 13 of the plastic pump housing. Extending from the radial flange is an elongated cylindrical body portion 19 which runs along motor shaft 21 into the metallic motor housing. With this arrangement, the heat picked up in the pump chamber is transferred to and dumped into the motor housing. To be particularly noted in FIG. 3 is the location of the heat sink where the heat pick up end 17 sits immediately behind the motor shaft seal and uses the shaft itself as a guide for extending into the motor housing. This also means that shaft 21 around which the heat sink is located enhances the heat transfer capacity of the heat sink, i.e. the shaft itself will help to transfer the heat picked up by the heat sink.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A pump arrangement comprising a plastic pump housing secured to a motor housing and including heat transfer means extending between said housings such that said heat transfer means of a highly heat conductive material picks up heat generated in said plastic pump housing and transfers the heat picked up to said motor housing, said arrangement including a metallic motor shaft extending from said motor housing into said pump housing and said heat transfer means comprising a heat sink including a cylindrical body portion having a radial flange at one end thereof in a pumping chamber of said pump housing for picking up heat in said pumping chamber and transferring same into said motor housing.

2. A pump arrangement as claimed in claim 1, wherein said motor housing has a metallic construction.

* * * * *